US007525002B2

(12) United States Patent
Umansky et al.

(10) Patent No.: US 7,525,002 B2
(45) Date of Patent: Apr. 28, 2009

(54) GASOLINE PRODUCTION BY OLEFIN POLYMERIZATION WITH AROMATICS ALKYLATION

(75) Inventors: Benjamin S. Umansky, Fairfax, VA (US); Michael C. Clark, Pasadena, TX (US); Ajit B. Dandekar, New York, NY (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 298 days.

(21) Appl. No.: 11/362,128

(22) Filed: Feb. 27, 2006

(65) Prior Publication Data

US 2006/0194995 A1 Aug. 31, 2006

Related U.S. Application Data

(60) Provisional application No. 60/656,947, filed on Feb. 28, 2005, provisional application No. 60/656,954, filed on Feb. 28, 2005, provisional application No. 60/656,955, filed on Feb. 28, 2005, provisional application No. 60/656,945, filed on Feb. 28, 2005.

(51) Int. Cl.
*C07C 2/12* (2006.01)
*C07C 2/66* (2006.01)

(52) U.S. Cl. ..... 585/323; 585/302; 585/304; 585/467; 585/449; 585/533

(58) Field of Classification Search ..... 585/302, 585/304, 323, 467, 449, 533
See application file for complete search history.

(56) References Cited

U.S. PATENT DOCUMENTS 2,381,175 A * 8/1945 Mattox ..... 585/316
3,751,504 A 8/1973 Keown ..... 260/672

(Continued)

FOREIGN PATENT DOCUMENTS

CN 1464035 12/2003

(Continued)

OTHER PUBLICATIONS

R. J. Hengstebeck, "Petroleum Processing Principles and Applications", (1959), pp. 212-218, New York, McGraw-Hill Book Company, Lib. Cong. Cat. No. 58-13006.

(Continued)

*Primary Examiner*—Thuan Dinh Dang
(74) *Attorney, Agent, or Firm*—Gerald L. Harris

(57) ABSTRACT

A process for the production of high octane number gasoline from light refinery olefins, typically from the catalytic cracking unit, and benzene-containing aromatic streams such as reformate. A portion of the light olefins including ethylene and propylene is polymerized to form a gasoline boiling range product and another portion is used to alkylate the light aromatic stream. The alkylation step may be carried out in successive stages with an initial low temperature stage using a catalyst comprising an MWW zeolite followed by a higher temperature stage using a catalyst comprising an intermediate pore size zeolite such as ZSM-5. Using this staged approach, the alkylation may be carried out in the vapor phase. Alternatively, the alkylation may be carried out in the liquid phase using the heavier olefins (propylene, butene) dissolved into the aromatic stream by selective countercurrent extraction; a separate alkylation step using the ethylene not taken up in the extraction is carried out at a higher temperature.

14 Claims, 4 Drawing Sheets

U.S. PATENT DOCUMENTS

| | | | | | |
|---|---|---|---|---|---|
| 4,016,218 | A | | 4/1977 | Haag | 260/671 |
| 4,153,638 | A | | 5/1979 | Bercik et al. | |
| 4,169,111 | A | | 9/1979 | Wight | 585/323 |
| 4,456,779 | A | | 6/1984 | Owen | 585/415 |
| 4,459,426 | A | | 7/1984 | Inwood et al. | 585/323 |
| 4,463,211 | A | | 7/1984 | Manning | |
| 4,471,147 | A | * | 9/1984 | Owen et al. | 585/519 |
| 4,547,605 | A | | 10/1985 | Kresge | 585/467 |
| 4,579,990 | A | | 4/1986 | Keyworth | |
| 4,891,458 | A | | 1/1990 | Innes | 585/323 |
| 4,954,325 | A | | 9/1990 | Rubin | 423/328 |
| 4,956,514 | A | | 9/1990 | Chu | 585/533 |
| 4,992,606 | A | | 2/1991 | Kushnerick | 585/467 |
| 5,077,445 | A | | 12/1991 | Le | 585/467 |
| 5,175,185 | A | | 12/1992 | Chandraratna | 514/445 |
| 5,185,486 | A | | 2/1993 | Collin et al. | |
| 5,236,575 | A | | 8/1993 | Bennett | 208/46 |
| 5,334,795 | A | | 8/1994 | Chu | 585/467 |
| 5,336,820 | A | * | 8/1994 | Owen et al. | 585/323 |
| 5,371,310 | A | | 12/1994 | Bennett | 585/467 |
| 5,493,065 | A | | 2/1996 | Cheng | 585/467 |
| 5,877,370 | A | | 3/1999 | Gajda | |
| 5,900,520 | A | | 5/1999 | Mazzone | 585/467 |
| 5,902,917 | A | | 5/1999 | Collins | 585/323 |
| 5,907,073 | A | | 5/1999 | Ghosh | 585/467 |
| 6,025,534 | A | | 2/2000 | Valente | |
| 6,043,402 | A | | 3/2000 | Gajda | |
| 6,051,521 | A | | 4/2000 | Cheng | 502/86 |
| 6,060,632 | A | | 5/2000 | Takamatsu | 585/467 |
| 6,284,938 | B1 | | 9/2001 | Stine et al. | |
| 6,479,721 | B1 | | 11/2002 | Gajda | |
| 6,500,999 | B2 | | 12/2002 | Di Girolamo et al. | |
| 6,703,356 | B1 | | 3/2004 | Wu | 508/591 |
| 6,855,855 | B2 | | 2/2005 | Van Den Brink et al. | |
| 6,872,864 | B2 | | 3/2005 | Gajda | |
| 2004/0171899 | A1 | | 9/2004 | Pohl | |
| 2004/0181106 | A1 | | 9/2004 | Numinen et al. | |
| 2004/0198586 | A1 | | 10/2004 | Mohr et al. | |
| 2006/0135832 | A1 | | 6/2006 | Vora et al. | |

FOREIGN PATENT DOCUMENTS

| | | | |
|---|---|---|---|
| WO | WO 127053 | | 4/2001 |
| WO | WO 01/83408 | A1 | 11/2001 |
| WO | WO 01/96013 | A1 | 12/2001 |
| WO | WO 02060191 | | 8/2002 |
| WO | WO 03/076074 | A1 | 9/2003 |
| WO | WO 2004/085062 | A1 | 10/2004 |

OTHER PUBLICATIONS

UOP LLC, "UOP Catalytic Condensation Process for Higher Olefins", (2004).
UOP LLC, "SPA-1™ and SPA-2™ Catalysts" (2004).
PCT Search Report.
International Search Report, PCT/US2007/017172, mailed Feb. 22, 2008.
Written Opinion, PCT Application No. PCT/US2007/017172, mailed Feb. 22, 2008.
Written Opinion, Australian Patent Office, SG 200705790-4, Sep. 8, 2008.

* cited by examiner

GASOLINE PRODUCTION BY OLEFIN POLYMERIZATION WITH AROMATICS ALKYLATION

CROSS REFERENCE TO RELATED APPLICATIONS

This application claims priority from U.S. Application Ser. No. 60/656/947, filed 28 Feb. 2005, entitled "Olefins Upgrading Process".

This application is related to co-pending applications Ser. Nos. 11/362,257, 11/362,256, 11/362,255 and 11/362,139, of even date, claiming priority, respectively from U.S. Applications Ser. Nos. 60/656,954, 60/656,955, 60/656,945 and 60/656,946, all filed 28 Feb. 2005 and entitled respectively, "Gasoline Production By Olef in Polymerization", "Process for Making High Octane Gasoline with Reduced Berizene Content", "Vapor Phase Aromatics Alkylation Process" and "Liquid Phase Aromatics Alkylation Process".

Reference is made to the above applications for further details of the combined, integrated process described below as they are referred to in this application.

FIELD OF THE INVENTION

This invention relates to a process for the production of gasoline boiling range motor fuel by the polymerization of refinery olefins and by the reaction of the olefins with aromatic hydrocarbons.

BACKGROUND OF THE INVENTION

Following the introduction of catalytic cracking processes in petroleum refining in the early 1930s, large amounts of olefins, particularly light olefins such as ethylene, propylene, butylene, became available in copious quantities from catalytic cracking plants in refineries. While these olefins may be used as petrochemical feedstock, many conventional petroleum refineries producing petroleum fuels and lubricants are not capable of diverting these materials to petrochemical uses. Processes for producing fuels from these cracking off gases are therefore desirable and from the early days, a number of different processes evolved. The early thermal polymerization process was rapidly displaced by the superior catalytic processes of which there was a number. The first catalytic polymerization process used a sulfuric acid catalyst to polymerize isobutene selectively to dimers which could then be hydrogenated to produce a branched chain octane for blending into aviation fuels. Other processes polymerized isobutylene with normal butylene to form a co-dimer which again results in a high octane, branched chain product. An alternative process uses phosphoric acid as the catalyst, on a solid support and this process can be operated to convert all the $C_3$ and $C_4$ olefins into high octane rating, branched chain polymers. This process may also operate with a $C_4$ olefin feed so as to selectively convert only isobutene or both n-butene and isobutene. This process has the advantage over the sulfuric acid process in that propylene may be polymerized as well as the butenes and at the present time, the solid phosphoric acid [SPA] polymerization process remains the most important refinery polymerization process for the production of motor gasoline.

In the SPA polymerization process, feeds are pretreated to remove hydrogen sulfide and mercaptans which would otherwise enter the product and be unacceptable, both from the view point of the effect on octane and upon the ability of the product to conform to environmental regulations. Typically, a feed is washed with caustic to remove hydrogen sulfide and mercaptans, after which it is washed with water to remove organic basis and any caustic carryover. Because oxygen promotes the deposition of tarry materials on the catalyst, both the feed and wash water are maintained at a low oxygen level. Additional pre-treatments may also be used, depending upon the presence of various contaminants in the feeds. With the most common solid phosphoric acid catalyst, namely phosphoric acid on kieselguhr, the water content of the feed needs to be controlled carefully because if the water content is too high, the catalyst softens and the reactor may plug. Conversely, if the feed is too dry, coke tends to deposit on the catalyst, reducing its activity and increasing the pressure drop across the reactor. As noted by Henckstebeck, the distribution of water between the catalyst and the reactants is a function of temperature and pressure which vary from unit to unit, and for this reason different water concentrations are required in the feeds to different units. *Petroleum Processing Principles And Applications,* R. J. Henckstebeck McGraw-Hill, 1959.

There are two general types of units used for the SPA process, based on the reactor type, the unit may be classified as having chamber reactors or tubular reactors. The chamber reactor contains a series of catalyst beds with bed volume increasing from the inlet to the outlet of the reactor, with the most common commercial design having five beds. The catalyst load distribution is designed to control the heat of conversion.

Chamber reactors usually operate with high recycle rates. The recycle stream, depleted in olefin content following polymerization, is used to dilute the olefin at the inlet of the reactor and to quench the inlets of the following beds. Chamber reactors usually operate at pressure of approximately 3500-5500 kPag (about 500-800 psig) and temperature between 180° to 200° C. (about 350°-400° F.). The conversion, per pass of the unit, is determined by the olefin specification in the LPG product stream. Fresh feed LHSV is usually low, approximately 0.4 to 0.8 $hr^{-1}$. The cycle length for chamber reactors is typically between 2 to 4 months.

The tubular reactor is basically a shell-and-tube heat exchanger in which the polymerization reactions take place in a number of parallel tubes immersed in a cooling medium and filled with the SPA catalyst. Reactor temperature is controlled with the cooling medium, invariably water in commercial units, that is fed on the shell side of the reactor. The heat released from the reactions taking place inside the tubes evaporates the water on the shell side. Temperature profile in a tubular reactor is close to isothermal. Reactor temperature is primarily controlled by means of the shell side water pressure (controls temperature of evaporation) and secondly by the reactor feed temperature. Tubular reactors usually operate at pressure between 5500 and 7500 kPag (800-1100 psig) and temperature of around 200° C. (about 400° F.). Conversion per pass is usually high, around 90 to 93% and the overall conversion is around 95 to 97%. The space velocity in tubular reactors is typically high, e.g., 2 to 3.5 $hr^{-1}$ LHSV. Cycle length in tubular reactors is normally between 2 to 8 weeks.

For the production of motor gasoline only butene and lighter olefins are employed as feeds to polymerization processes as heavier olefins up to about $C_{10}$ or $C_{11}$ can be directly incorporated into the gasoline. With the PSA process, propylene and butylene are satisfactory feedstocks and ethylene may also be included, to produce a copolymer product in the gasoline boiling range. Limited amounts of butadiene may be permissible although this diolefin is undesirable because of its tendency to produce higher molecular weight polymers and to accelerate deposition of coke on the catalyst. The process generally operates under relatively mild conditions, typically between 150° and 200° C., usually at the lower end of this range between 150° and 180° C., when all butenes are polymerized. Higher temperatures may be used when propylene is included in the feed. In a well established commercial SPA polymerization process, the olefin feed together with paraffinic diluent, is fed to the reactor after being preheated by exchange with the reaction effluent. Control of the heat release in the reactor is accomplished in unit with chamber type reactors by feed dilution and recycle quench between the catalyst beds in the reactor and with tubular reactor units, temperature control is achieved by means of the coolant medium surrounding the reactors. The solid phosphoric acid catalyst used is non-corrosive, which permits extensive use of carbon steel throughout the unit. The highest octane product is obtained by using a butene feed, with a product octane rating of [R+M]/2 of 91 being typical. With a mixed propylene/butene feed, product octane is typically about 91 and with propylene as the primary feed component, product octane drops to typically 87.

In spite of the advantages of the SPA polymerization process, which have resulted in over 200 units being built since 1935 for the production of gasoline fuel, a number of disadvantages are encountered, mainly from the nature of the catalyst. Although the catalyst is non-corrosive, so that much of the equipment may be made of carbon steel, it does lead it to a number of drawbacks in operation. First, the catalyst life is relatively short as a result of pellet disintegration which causes an increase in the reactor pressure drop. Second, the spent catalyst encounters difficulties in handling from the environmental point of view, being acidic in nature. Third, operational and quality constraints limit flexible feedstock utilization. Obviously, a catalyst which did not have these disadvantages would offer considerable operating and economic advantages.

In recent years, environmental laws and regulations the have limited the amount of benzene which is permissible in petroleum motor fuels. These regulations have produced substantial changes in refinery operation. To comply with these regulations, some refineries have excluded $C_6$ compounds from reformer feed so as to avoid the production of benzene directly. An alternative approach is to remove the benzene from the reformate after it is formed by means of an aromatics extraction process such as the Sullfolane Process or UDEX Process. Well-integrated refineries with aromatics extraction units associated with petrochemical plants usually have the ability to accommodate the benzene limitations by diverting extracted benzene to petrochemicals uses but it is more difficult to meet the benzene specification for refineries without the petrochemical capability. While sale of the extracted benzene as product to petrochemicals purchasers is often an option, it has the disadvantage of losing product to producers who will add more value to it and, in some cases, transportation may present its own difficulties in dealing with bulk shipping of a chemical classed as a hazardous material.

The removal of benzene is, however, accompanied by a decrease in product octane quality since benzene and other single ring aromatics make a positive contribution to product octane. Certain processes have been proposed for converting the benzene in aromatics-containing refinery streams to the less toxic alkylaromatics such as toluene and ethyl benzene which themselves are desirable as high octane blend components. One process of this type was the Mobil Benzene Reduction (MBR) Process which, like the closely related MOG Process, used a fluidized zeolite catalyst in a riser reactor to alkylate benzene in reformate to from alkylaromatics such as toluene. The MBR and MOG processes are described in U.S. Pat. Nos. 4,827,069; 4,950,387; 4,992,607 and 4,746,762.

Another problem facing petroleum refineries without convenient outlets for petrochemical feedstocks is that of excess light olefins. Following the introduction of catalytic cracking processes in petroleum refining in the early 1930s, large amounts of olefins, particularly light olefins such as ethylene, propylene, butylene, became available in copious quantities from catalytic cracking plants in refineries. While these olefins are highly useful as petrochemical feedstocks, the refineries without petrochemical capability or economically attractive and convenient markets for these olefins may have to use the excess light olefins in fuel gas, at a significant economic loss or, alternatively, convert the olefins to marketable liquid products. A number of different polymerization processes for producing liquid motor fuels from cracking off-gases evolved following the advent of the catalytic cracking process but at the present, the solid phosphoric acid [SPA] polymerization process remains the most important refinery polymerization process for the production of motor gasoline. This process has however, its own drawbacks, firstly in the need to control the water content of the feed closely because although a limited water content is required for catalyst activity, the catalyst softens in the presence of excess water so that the reactor may plug with a solid, stone-like material which is difficult to remove without drilling or other arduous operations. Conversely, if the feed is too dry, coke tends to deposit on the catalyst, reducing its activity and increasing the pressure drop across the reactor. Environmental regulation has also affected the disposal of cracking olefins from these non-integrated refineries by restricting the permissible vapor pressure (usually measured as Reid Vapor Pressure, RVP) of motor gasolines especially in the summer driving season when fuel volatility problems are most noted, potentially creating a need for additional olefin utilization capacity.

Refineries without their own petrochemicals plants or ready markets for benzene or excess light olefins therefore encounter problems from two different directions and for these plants, processes which would enable the excess olefins and the benzene to be converted to marketable products would be desirable.

The fluid bed MBR Process uses a shape selective, metallosilicate catalyst, preferably ZSM-5, to convert benzene to alkylaromatics using olefins from sources such as FCC or coker fuel gas, excess LPG or light FCC naphtha. Normally, the MBR Process has relied upon light olefin as alkylating agent for benzene to produce alkylaromatics, principally in the $C_7$-$C_8$ range. Benzene is converted, and light olefin is also upgraded to gasoline concurrent with an increase in octane value. Conversion of light FCC naphtha olefins also leads to substantial reduction of gasoline olefin content and vapor pressure. The yield-octane uplift of MBR makes it one of the few gasoline reformulation processes that is actually economically beneficial in petroleum refining.

Like the MOG Process, however, the MBR Process required considerable capital expenditure, a factor which did not favor its widespread application in times of tight refining margins. The MBR process also used higher temperatures and $C_5$+ yields and octane ratings could in certain cases be deleteriously affected another factor which did not favor widespread utilization. Other refinery processes have also been proposed to deal with the problems of excess refinery olefins and gasoline; processes of this kind have often functioned by the alkylation of benzene with olefins or other alkylating agents such as methanol to form less toxic alkylaromatic precursors. Exemplary processes of this kind are described in U.S. Pat. Nos. 4,950,823; 4,975,179; 5,414,172; 5,545,788; 5,336,820; 5,491,270 and 5,865,986.

While these known processes are technically attractive they, like the MOG and MBR processes, have encountered the disadvantage of needing to a greater or lesser degree, some capital expenditure, a factor which militates strongly against them in present circumstances.

For these reasons, a refinery process capable of being installed at relatively low capital cost and having the capability to alkylate benzene (or other aromatics) with the olefins would be beneficial to meet gasoline benzene specifications, increase motor fuel volume with high-octane alkylaromatic compounds and be economically acceptable in the current plant investment climate. For some refineries, the reactive removal of $C_2/C_3$ olefins could alleviate fuel gas capacity limitations. Such a process should:

- Upgrade $C_2$ and $C_3$ olefin from fuel gas to high octane blending gasoline Increase flexibility in refinery operation to control benzene content in the gasoline blending pool
- Allow refineries with benzene problems to feed the $C_6$ components (low blending octane values) to the reformer, increasing both the hydrogen production from the reformer and the blend pool octane. Benzene produced in the reformer will be removed in order to comply with gasoline product specifications.
- Have the potential, by the removal of olefins from the fuel gas, to increase capacity in the fuel system facility. For some refineries this benefit could allow an increase in severity in some key refinery process, FCC, hydrocracker, coker, etc.

The necessity of keeping capital cost low obviously favors fixed bed catalytic units over the fluid bed type operations such as MOG and MBR. Fixed bed aromatics alkylation processes have achieved commercial scale use in the petrochemical field. The Cumene Process offered for license first by Mobil Oil Corporation and now by ExxonMobil Chemical Company is a low-capital cost process using a fixed bed of a zeolite alkylation/transalkylation catalyst to react refinery propylene with benzene to produce petrochemical grade cumene. Processes for cumene manufacture using various molecular sieve catalysts have been described in the patent literature: for example, U.S. Pat. No. 3,755,483 describes a process for making petrochemical cumene from refinery benzene and propylene using a fixed bed of ZSM-12 catalyst; U.S. Pat. No. 4,393,262 and U.S. also describe processes for making cumene from refinery benzene and propylene using ZSM-12 catalysts. The use of other molecular sieve catalysts for cumene manufacture has been described in other patents: U.S. Pat. No. 4,891,458 describes use of a zeolite beta catalyst; U.S. Pat. No. 5,149,894 describes the use of a catalyst containing the sieve material SSZ-25; U.S. Pat. No. 5,371,310 describes the use of a catalyst containing the sieve material MCM-49 in the transalkylation of diisopropyl benzene with benzene; U.S. Pat. No. 5,258,565 describes the use of a catalyst containing the sieve material MCM-36 to produce petrochemical grade cumene containing less than 500 ppm xylenes.

The petrochemical alkylation processes such as those referred to above, do not lend themselves directly to use in petroleum refineries without petrochemical capacity since they require pure feeds and their products are far more pure than required in fuels production. In addition, other problems may be encountered in the context of devising a process for motor gasoline production which commends itself for use in non-integrated, small-to-medium sized refineries. One such problem is the olefins from the cracker contain ethylene and propylene in addition to the higher olefins and if any process is to be economically attractive, it is necessary for it to consume both of the lightest olefins. Propylene is more reactive than ethylene and will form cumene by reaction with benzene at lower temperatures than ethylene will react to form ethylbenzene or xylenes (by transalkylation or disporportionation). Because of this, it is not possible with existing process technologies, to obtain comparable utilization of ethylene and propylene in a process using a mixed olefin feed from the FCCU. While improved ethylene utilization could in principle, be achieved by higher temperature operation, the thermodynamic equilibrium for the propylene/benzene reaction shifts away from cumene at temperatures above about 260° C. (500° F.), with consequent loss of this product.

SUMMARY OF THE INVENTION

We have now devised a process which enables light refinery olefins from the cracker (FCCU) to be utilized for the production of gasoline and possibly higher boiling fuel products such as kerojet or road diesel blend stock by two complementary routes in combination with one another in an integrated process unit. In one route, the olefins are polymerized (actually, oligomerized to form a relatively low molecular weight products boiling mainly in the gasoline boiling range although the traditional refinery term is polymerization) and by the complementary route, the mixed olefins are used to alkylate benzene from refinery sources to produce a high octane aromatic gasoline boiling range product. The process achieves good utilization of both the olefins present in a mixed olefin feed from the FCCU while operating under conditions favorable to the utilization of the ethylene and propylene in the stream; butenes may be included in the olefin feed if alternative outlets are not available. Thus, the present process provides a ready outlet for olefins in non-integrated refineries as well as a way of producing high octane, gasoline of controlled benzene content. The process is operated as a fixed bed process which requires only limited capital outlay and is therefore eminently suitable for implementation in small-to-medium sized refineries; in fact, being a relatively low pressure process, it may be operated in existing low pressure units with a minimal amount of modification.

According to the present invention, a mixed light olefin stream such as ethylene, propylene, and butylene, optionally with other light olefins, is polymerized to form a gasoline boiling range [$C_5$+-200° C.] [$C_5$+-400° F.] product in the presence of a catalyst which comprises a member of the MWW family of zeolites. The process is carried out in a fixed bed of the catalyst either in a chamber type reactor with feed dilution or added quench to control the heat release which takes place or in a tubular type reactor with external temperature control. The olefins are also utilized separately to alkylate a light aromatic stream such as reformate which contains benzene or other single ring aromatic compounds, e.g. xylene, as the extractant. The product streams from the two reactions are routed to a common recovery section for fractionation.

The aromatics alkylation reaction may be carried out under vapor phase, liquid phase or supercritical phase conditions (reactor inlet). Frequently, mixed phase conditions will prevail, depending on the feed composition and the conditions used. At the reactor outlet, liquid phase will prevail under normal conditions with the product including significant proportions of $C_8$, $C_{10}$ and higher hydrocarbons. With significant amounts of ethylene (FCC Off Gas) in the olefin feed, operation may commence (reactor inlet) in the vapor phase or under mixed phase conditions and when higher olefins including propylene and butene are present, operation may frequently commence in the supercritical phase. Vapor phase and liquid phase olefin/aromatic processes with preferred process configurations and process conditions are disclosed in co-pending, concurrently filed patent applications Ser. Nos. 11/362,255 and 11/362,139 (claiming priority from U.S. Ser. Nos. 60/656,945 and 60/656,946, entitled "Liquid Phase Aromatics Alkylation Process" and "Vapor Phase Aromatics Alkylation Process") to which reference is made for a description of these processes.

The integrated process unit comprises separate, parallel reaction sections in one of which the olefin oligomerization is carried out and in the other, the aromatics alkylation reaction. In one variant of the present process, the olefin oligomerization reaction is carried out in the presence of a catalyst which comprises a zeolite of the MWW family, as described in co-pending, concurrently filed patent application U.S. Ser. No. 11/362,257 (claiming priority from Ser. No. 60/656,964), entitled "Gasoline Production by Olefin Polymerization" with the aromatic alkylation reaction carried out in the second reactor sections under the general reaction conditions described in co-pending, concurrently filed patent application U.S. Ser. No. 11/362,256 (claiming priority from Ser. No. 60/656,955) entitled "Process For Making High Octane Gasoline With Reduced Benzene Content". In specific types of alkylation process, the aromatic alkylation may also be carried under either vapor phase conditions, using two different catalysts in order to secure optimum olefin utilization, as described in co-pending, concurrently filed patent application Ser. No. 11/362,255 (claiming priority of U.S. Ser. No. 60/656,946, entitled "Vapor Phase Aromatics Alkylation Process" or under liquid phase conditions as described in co-pending, concurrently filed patent application Ser. No. 11/362,139 (claiming priority from U.S. Ser. No. 60/656,946), entitled "Liquid Phase Aromatics Alkylation Process". These process variants are described in greater detail below with reference to the other applications to which reference is made for a detailed description of those parts of the overall process.

DRAWINGS

DETAILED DESCRIPTION OF THE INVENTION

Process Configuration

Figure 1:
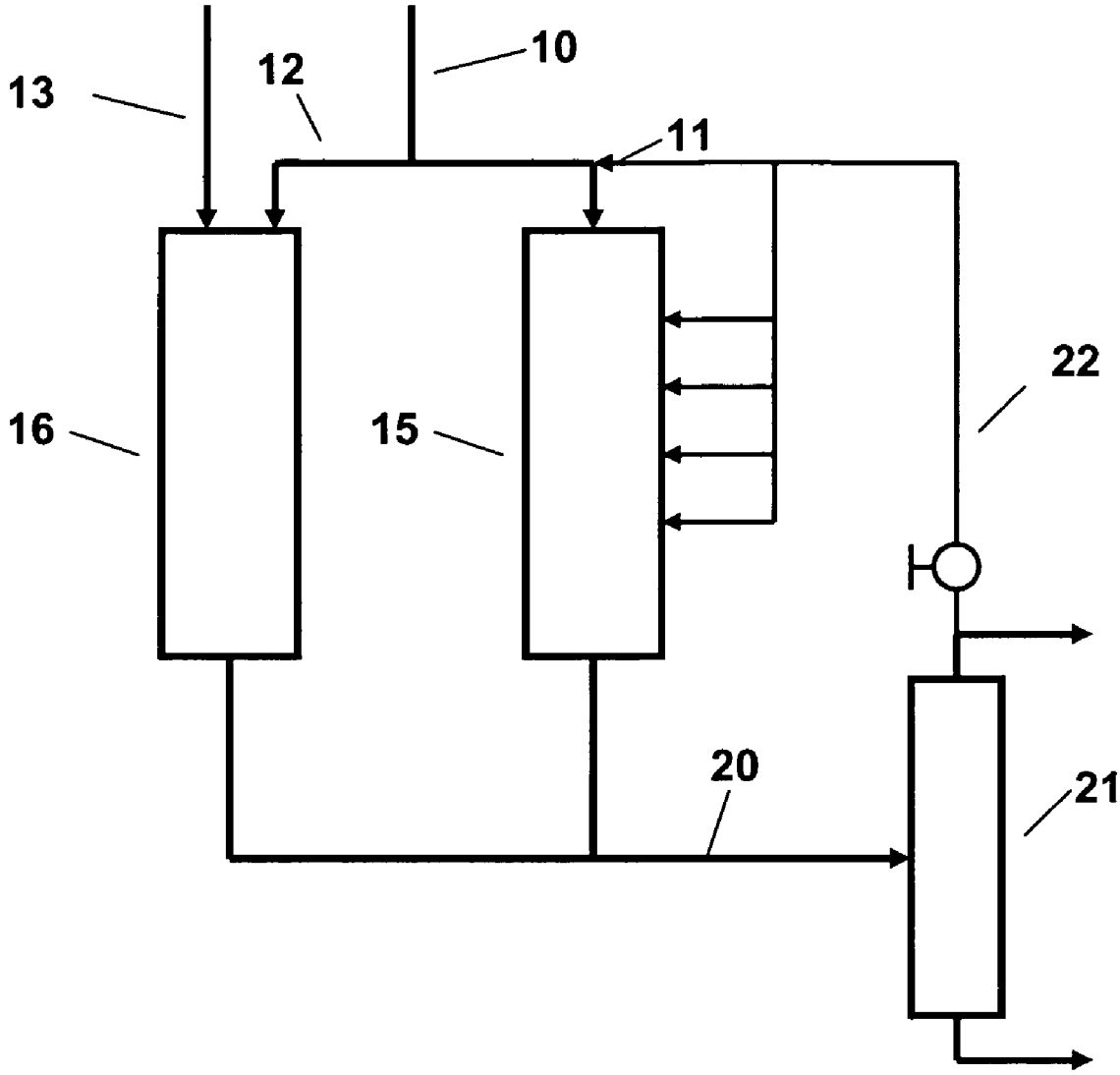
FIG. 1 shows a process schematic for polymerizing mixed light refinery olefins to form a gasoline boiling range product and for converting the olefins and benzene to motor gasoline in a two-train, fixed bed process unit.

A schematic for an olefin polymerization/alkylation unit is shown in simplified form in FIG. 1. A stream of off-gases from a refinery fluid catalytic cracking unit (FCCU) including light mixed olefins, typically $C_2$, $C_3$ and $C_4$ olefins possibly with some higher olefins as well as light paraffins (methane, ethane, propane, butane) is led into the unit through line 10 and is split between the two reactor sections, entering polymerization reactor section 15 through line 11 and the aromatics alkylation reactor section 16 through line 12. A light refinery aromatics stream also enters the unit through line 13 and passes to the aromatics alkylation section in reactor train 16. In each case, the feed to the respective reactor section may be heated in heat exchangers and fired heaters (not shown) using the hot effluent from the reactors to supply heat to the feed in the conventional way. The feed may also be conducted through a guard bed reactor (not shown) prior to entering each of the two reactor trains n order to remove contaminants. The guard bed reactor may be operated on the swing cycle with two beds, one bed being used on stream for contaminant removal and the other on regeneration in the conventional manner. If desired, a three-bed guard bed system may be used with the two beds used in series for contaminant removal and the third bed on regeneration. With a three guard system used to achieve low contaminant levels by the two-stage series sorption, the beds will pass sequentially through a three-step cycle of: regeneration, second bed sorption, first bed sorption.

From the guard bed reactor, the split feeds enter the polymerization reactor section 15 and the benzene alkylation section 16 in which the respective olefin polymerization and aromatics alkylation reactions take place. Polymerization reaction section 15 is constructed similarly to the reactor portion of the olefin polymerization unit described and shown in co-pending application Ser. No. 11/362,257 (claiming priority of U.S. Ser. No. 60/656,954, "Gasoline Production by Olefin Polymerization"), that is, with multiple sequential fixed beds of catalyst with recycle for feed dilution and reaction quench as necessary; recycle may be derived from the product recovery section as described in the co-pending application. Aromatics alkylation section 16 conducts the aromatics alkylation reaction between the olefins in line 12 and the light refinery aromatics stream from line 13 under the general reaction conditions described in co-pending application Ser. No. 11/362,256 (claiming priority of U.S. Ser. No. 60/656,955, "Process For Making High Octane Gasoline With Reduced Benzene Content"). The products from the polymerization section 15 and alkylation section 16 are combined in line 20 and pass to product recovery section 21 for fractionation and stabilization. When required, separation of product for recycle and quench may be carried out at that point downstream of the reaction sections, as described in co-pending application Ser. No. 11/362,257 (claiming priority of U.S. Ser. No. 60/656,954, "Gasoline Production by Olefin Polymerization"), with product recovery being carried out as described in that application.

Figure 2:
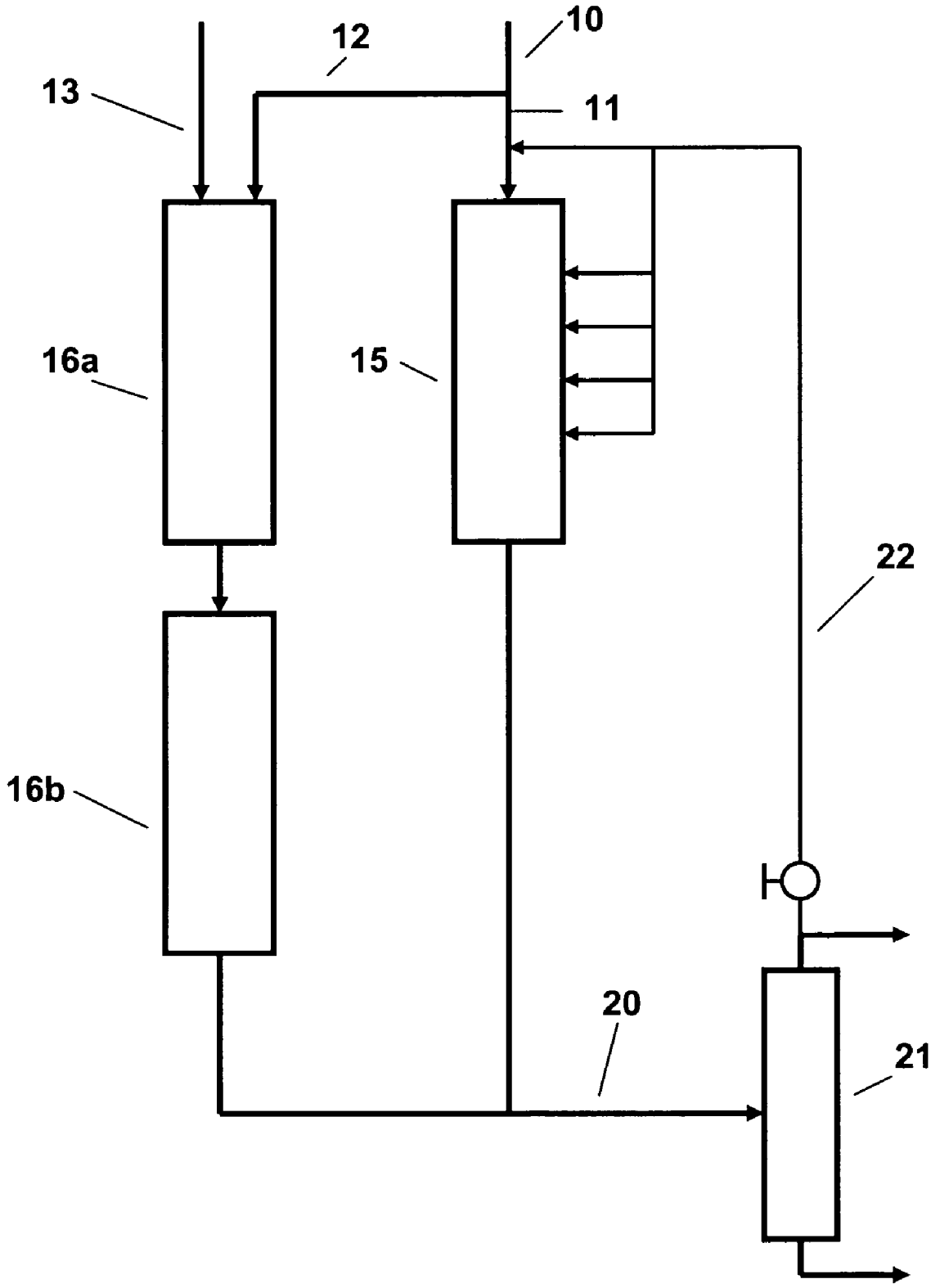
FIG. 2 shows a process schematic for polymerizing mixed light refinery olefins to form a gasoline boiling range product and for converting the olefins and benzene to motor gasoline in a vapor phase alkylation reaction.

FIG. 2 shows a process unit in which the aromatics alkylation is carried out under vapor phase conditions as described in co-pending application No. (claiming priority of U.S. Ser. No. 60/656,945, "Vapor Phase Aromatics Alkylation Process). In this configuration, the aromatics alkylation is carried out in two sequential process steps, one in which propylene (and higher olefin) alkylation is favored using a catalyst of the MWW family and a second step in which alkylation with the ethylene in the feed is favored by the use of a different, intermediate pore size zeolite such as ZSM-5. Because the alkylation reactions are exothermic and equilibrium for the ethylene alkylation reaction is favored by higher temperatures, the reaction over the MWW zeolite preferably takes place first so that the reaction heat increases the temperature of the stream to the extent desired for the second reaction at a higher temperature. In this case, the olefin polymerization reaction is carried out in reactor 15 while the alkylation reactions are carried out in reactors 16*a* and 16*b*. The alkylation reaction over the MWW zeolite is carried out in reactor 16*a* and the reaction over the other intermediate pore size zeolite in reactor 16*b*, following which the effluent streams are combined as described above for product recovery and the provision of any desired recycle streams through line 22 for feed dilution and quench in polymerization section 15.

Figure 3:
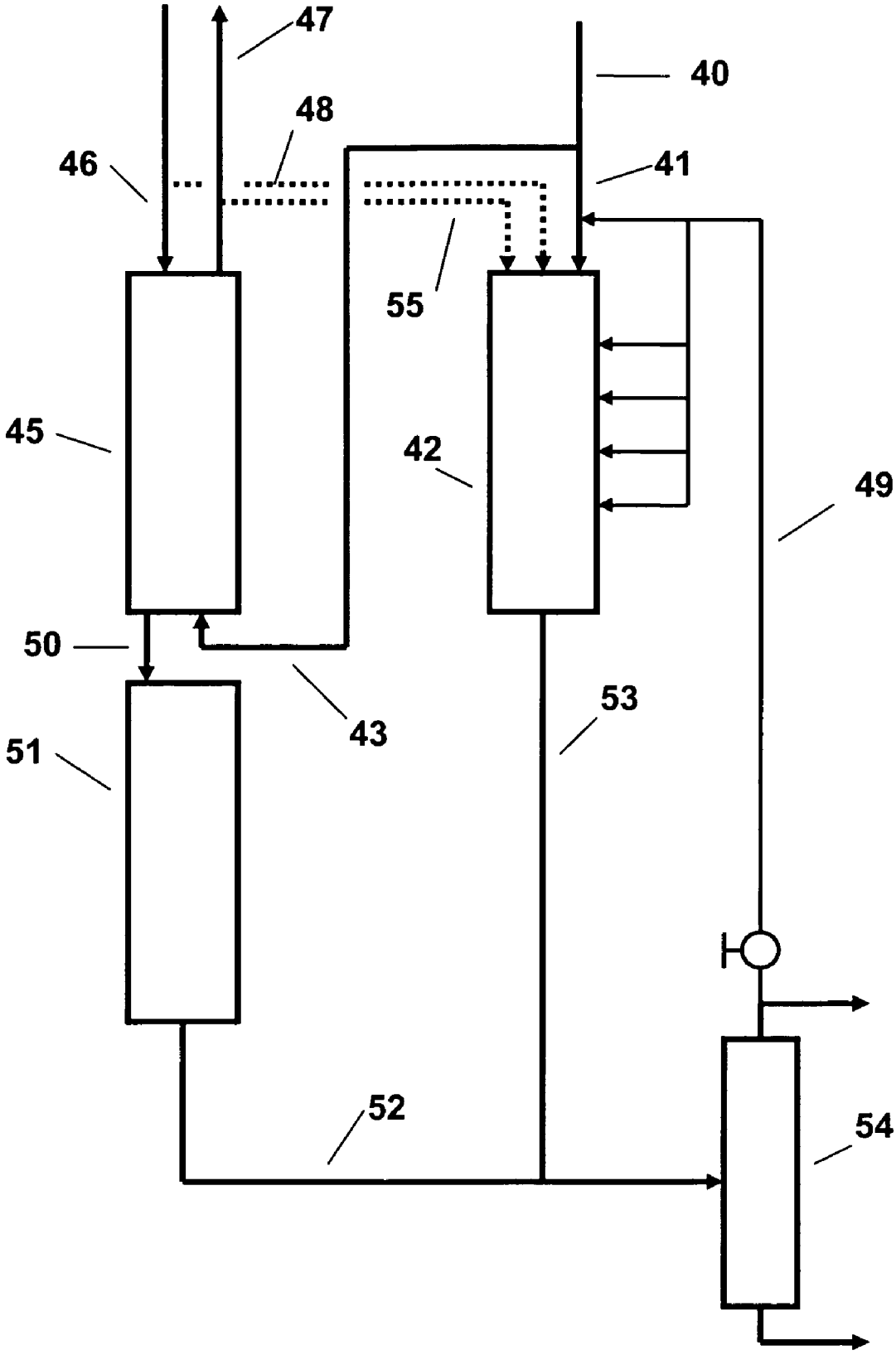
FIG. 3 shows a process schematic for polymerizing mixed light refinery olefins to form a gasoline boiling range product and for converting the olefins and benzene to motor gasoline in a liquid phase alkylation reaction.

In the process unit shown in FIG. 3, the alkylation section utilizes a liquid phase reaction between the olefin stream and the aromatics stream, in which the relatively heavier olefins are first extracted from the mixed olefin stream by passage through the aromatics stream, as described in co-pending application Ser. No. 11/362,139 (claiming priority from U.S. Ser. No. 60/656,946, "Liquid Phase Aromatics Alkylation Process"). A stream of off-gases from a refinery fluid catalytic cracking unit (FCCU) is led into the unit through line 40 and is split between the two reactor sections, entering polymerization reactor section 42 through line 41 with a stream diverted to absorber 45 through line 43. The olefins entering polymerization reactor 42 are polymerized as described application Ser. No. 11/362,257 (claiming priority from U.S. Ser. No. 60/656,954, "Gasoline Production by Olefin Polymerization") using a zeolite catalyst selected from the MWW family of zeolites. The olefin stream entering absorber 45 passes in countercurrent with a stream of light aromatics entering the absorber through line 46 to absorb olefins from the olefin stream with preferential absorption of the relatively heavier olefins e.g. butene. The absorption takes place under the conditions described in application Ser. No. 11/362,139 (claiming priority from U.S. Ser. No. 60/656,946, "Liquid Phase Aromatics Alkylation Process"). The components in the FCC off-gases which are not sorbed by the aromatic stream, mainly the light paraffins methane, ethane, propane and butane pass out of the absorber through line 47 and can used as refinery fuel gas. If conditions in the absorber permit residual olefins, mainly ethylene, to remain, the stream leaving absorber 45 may be sent through line 48 to be sent to polymerization reactor 42 to be converted to liquid polymerization products by direct polymerization. Saturated hydrocarbons in the stream in line 48 from the absorber will act as diluent for the olefins and assist temperature control in the polymerization reactor and may reduce the need for feed diluent and quench from the product recovery section in line 49.

The light aromatics stream containing the olefins removed from the olefin stream is sent through line 50 to aromatics alkylation reactor 51 in which the liquid phase aromatics alkylation reactions described in application Ser. No. 11/362,139 (claiming priority from U.S. Ser. No. 60/656,946, "Liquid Phase Aromatics Alkylation Process)" take place, suitably under the conditions described in that application. Alkylaromatic product is removed through line 52 and is combined with the product from polymerization reactor in line 53 to be sent to the common fractionation/product recovery section 54. If desired, in order to maintain operating flexibility or for temperature control in the polymerization reactor, a portion of the light aromatic stream may be diverted from line 46 and sent through line 48 to polymerization reactor 42. By sending the aromatic stream to the polymerization reactor in this way, it may be possible to reduce the amount of recycle or quench coming through line 49 which would otherwise be required to reduce the exotherm in the polymerization reactor.

In each case, the feed to the respective reactor may be heated in heat exchangers and fired heaters (not shown) using hot effluent from the reactors to supply heat to the feed in the conventional way. The feed may also be conducted through a guard bed reactor (not shown) prior to entering each of the two reactor trains in order to remove contaminants such as organic nitrogen and sulfur-containing impurities. The guard bed may be operated on the swing cycle with two beds, one bed being used on stream for contaminant removal and the other on regeneration in the conventional manner. If desired, a three-bed guard bed system may be used with the two beds used in series for contaminant removal and the third bed on regeneration. With a three guard system used to achieve low contaminant levels by the two-stage series sorption, the beds will pass sequentially through a three-step cycle of: regeneration, second bed sorption, first bed sorption.

The catalyst used in the guard bed will normally be the same catalyst used in the alkylation reactor as a matter of operating convenience but this is not required: if desired another catalyst or sorbent to remove contaminants from the feed may used, typically a cheaper guard bed sorbent, e.g. a used catalyst from another process or alumina. The objective of the guard bed is to remove the contaminants from the feed before the feed comes to the reaction catalyst and provided that this is achieved, there is wide variety of choice as to guard bed catalysts and conditions useful to this end.

Olefin Feed

The mixed light olefins used as the feed for the present process are normally obtained by the catalytic cracking of petroleum feedstocks to produce gasoline as the major product. The catalytic cracking process, usually in the form of fluid catalytic cracking (FCC) is well established and, as is well known, produces large quantities of light olefins as well as olefinic gasolines and by-products such as cycle oil which are themselves subject to further refining operations. The olefins which are primarily useful in the present process are the lighter olefins from ethylene up to butene; although the heavier olefins up to octene may also be included in the processing, they can generally be incorporated directly into the gasoline product where they provide a valuable contribution to octane. The present process is highly advantageous in that it will operate readily not only with butene and propylene but also with ethylene and thus provides a valuable route for the conversion of this cracking by-product to the desired gasoline product. For this reason as well as their ready availability in large quantities in a refinery, mixed olefin streams such a FCC Off-Gas streams (typically containing ethylene, propylene and butenes) may be used. Conversion of the $C_3$ and $C_4$ olefin fractions from the cracking process provides a direct route to the branch chain $C_6$, $C_7$ and $C_8$ products which are so highly desirable in gasoline from the view point of boiling point and octane. Besides the FCC unit, the mixed olefin streams may be obtained from other process units including cokers, visbreakers and thermal crackers. The presence of diolefins which may be found in some of these streams is not disadvantageous since catalysis on the MWW family of zeolites takes place on surface sites rather than in the interior pore structure as with more conventional zeolites so that plugging of the pores is less problematic catalytically. Appropriate adjustment of the process conditions will enable co-condensation condensation products to be produced when ethylene, normally less reactive than its immediate homologs, is included in the feed. The compositions of two typical FCC gas streams is given below in Tables 1 and 2, Table 1 showing a light FCC gas stream and Table 2 a stream from which the ethylene has been removed in the gas plant for use in the refinery fuel system.

TABLE 1

| FCC Light Gas Stream | | |
|---|---|---|
| Component | Wt. Pct. | Mol. Pct. |
| Ethane | 3.3 | 5.1 |
| Ethylene | 0.7 | 1.2 |
| Propane | 14.5 | 15.3 |
| Propylene | 42.5 | 46.8 |
| Iso-butane | 12.9 | 10.3 |
| n-Butane | 3.3 | 2.6 |
| Butenes | 22.1 | 18.32 |
| Pentanes | 0.7 | 0.4 |

TABLE 2

| $C_3$-$C_4$ FCC Gas Stream | |
|---|---|
| Component | Wt. Pct. |
| 1-Propene | 18.7 |
| Propane | 18.1 |
| Isobutane | 19.7 |
| 2-Me-1-propene | 2.1 |
| 1-Butene | 8.1 |
| n-Butane | 15.1 |
| Trans-2-Butene | 8.7 |
| Cis-2-butene | 6.5 |
| Isopentane | 1.5 |
| C3 Olefins | 18.7 |
| C4 Olefins | 25.6 |
| Total Olefins | 44.3 |

While the catalysts used in the present process are robust they do have sensitivity to certain contaminants (the conventional zeolite deactivators), especially organic compounds with basic nitrogen as well as sulfur-containing organics. It is therefore preferred to remove these materials prior to entering the unit if extended catalyst life is to be expected. Scrubbing with contaminant removal washes such as caustic, MEA or other amines or aqueous wash liquids will normally reduce the sulfur level to an acceptable level of about 10-20 ppmw and the nitrogen to trace levels at which it can be readily tolerated. One attractive feature about the present process is that it is not unduly sensitive to water, making it less necessary to control water entering the reactor than it is in SPA units. Unlike SPA, the zeolite catalyst does not require the presence of water in order to maintain activity and therefore the feed may be dried before entering the unit. In conventional SPA units, the water content typically needs to be held between 300 to 500 ppmw for adequate activity while, at the same time, retaining catalyst integrity. The present zeolite catalysts, however, may readily tolerate up to about 1,000 ppmw water although levels above about 800 ppmw may reduce activity, depending on temperature.

Aromatic Feed

The light aromatic stream contains benzene and may contain other single ring aromatic compounds including alkylaromatics such as toluene, ethylbenzene, propylbenzene (cumene) and the xylenes. In refineries with associated petrochemical capability, these alkylaromatics will normally be removed for higher value use as chemicals or, alternatively, may be sold separately for such uses. Since they are already considered less toxic than benzene, there is no environmental requirement for their inclusion in the aromatic feed stream but, equally, there is no prejudice against their presence unless conditions lead to the generation of higher alkylaromatics which fall outside the gasoline range or which are undesirable in gasoline, for example, durene. The amount of benzene in this stream is governed mainly by its source and processing history but in most cases will typically contain at least about 5 vol. % benzene, although a minimum of 12 vol. % is more typical, more specifically about 20 vol. % to 60 vol. % benzene. Normally, the main source of this stream will be a stream from the reformer which is a ready source of light aromatics. Reformate streams may be full range reformates, light cut reformates, heavy reformates or heart cut reformates. These fractions typically contain smaller amounts of lighter hydrocarbons, typically less than about 10% $C_5$ and lower hydrocarbons and small amounts of heavier hydrocarbons, typically less than about 15% $C_7$+hydrocarbons. These reformate feeds usually contain very low amounts of sulfur as, usually, they have been subjected to desulfurization prior to reforming so that the resulting gasoline product formed in the present process contains an acceptably low level of sulfur for compliance with current sulfur specifications.

Reformate streams will typically come from a fixed bed, swing bed or moving bed reformer. The most useful reformate fraction is a heart-cut reformate. This is preferably reformate having a narrow boiling range, i.e. a $C_6$ or $C_6/C_7$ fraction. This fraction is a complex mixture of hydrocarbons recovered as the overhead of a dehexanizer column downstream from a depentanizer column. The composition will vary over a range depending upon a number of factors including the severity of operation in the reformer and the composition of the reformer feed. These streams will usually have the $C_5$, $C_4$ and lower hydrocarbons removed in the depentanizer and debutanizer. Therefore, usually, the heart-cut reformate may contain at least 70 wt. % $C_6$ hydrocarbons (aromatic and non-aromatic), and preferably at least 90 wt. % $C_6$ hydrocarbons.

Other sources of aromatic, benzene-rich feeds include a light FCC naphtha, coker naphtha or pyrolysis gasoline but such other sources of aromatics will be less important or significant in normal refinery operation.

By boiling range, these benzene-rich fractions can normally be characterized by an end boiling point of about 120° C. (250° F.)., and preferably no higher than about 110° C. (230° F.). Preferably, the boiling range falls between 40° and 100° C. (100° F. and 212° F.)., and more preferably between the range of 65° to 95° C. (150° F. to 200 ° F.) and even more preferably within the range of 70° to 95° C. (160° F. to 200° F.).

The compositions of two typical heart cut reformate streams are given in Tables 3 and 4 below. The reformate shown in Table 4 is a relatively more paraffinic cut but one which nevertheless contains more benzene than the cut of Table 3, making it a very suitable substrate for the present alkylation process.

TABLE 3

| C6-C7 Heart Cut Reformate | |
|---|---|
| RON | 82.6 |
| MON | 77.3 |
| Composition, wt. pct. | |
| i-$C_5$ | 0.9 |
| n-$C_5$ | 1.3 |
| $C_5$ napthenes | 1.5 |
| i-$C_6$ | 22.6 |
| n-$C_6$ | 11.2 |
| $C_6$ naphthenes | 1.1 |
| Benzene | 32.0 |
| i-$C_7$ | 8.4 |
| n-$C_7$ | 2.1 |

TABLE 3-continued

| C6-C7 Heart Cut Reformate | |
|---|---|
| $C_7$ naphthenes | 0.4 |
| Toluene | 17.7 |
| i-$C_8$ | 0.4 |
| n-$C_8$ | 0.0 |
| $C_8$ aromatics | 0.4 |

TABLE 4

| Paraffinic C6-C7 Heart Cut Reformate | |
|---|---|
| RON | 78.5 |
| MON | 74.0 |
| Composition, wt. pct. | |
| i-$C_5$ | 1.0 |
| n-$C_5$ | 1.6 |
| $C_5$ napthenes | 1.8 |
| i-$C_6$ | 28.6 |
| n-$C_6$ | 14.4 |
| $C_6$ naphthenes | 1.4 |
| Benzene | 39.3 |
| i-$C_7$ | 8.5 |
| n-$C_7$ | 0.9 |
| $C_7$ naphthenes | 0.3 |
| Toluene | 2.3 |

Reformate streams will come from a fixed bed, swing bed or moving bed reformer. The most useful reformate fraction is a heart-cut reformate. This is preferably reformate having a narrow boiling range, i.e. a $C_6$ or $C_6/C_7$ fraction. This fraction is a complex mixture of hydrocarbons recovered as the overhead of a dehexanizer column downstream from a depentanizer column. The composition will vary over a range depending upon a number of factors including the severity of operation in the reformer and the composition of the reformer feed. These streams will usually have the $C_5$, $C_4$ and lower hydrocarbons removed in the depentanizer and debutanizer. Therefore, usually, the heart-cut reformate will contain at least 70 wt. % $C_6$ hydrocarbons, and preferably at least 90 wt. % $C_6$ hydrocarbons.

Other sources of aromatic, benzene-rich feeds include a light FCC naphtha, coker naphtha or pyrolysis gasoline but such other sources of aromatics will be less important or significant in normal refinery operation.

By boiling range, these benzene-rich fractions can normally be characterized by an end boiling point of about 120° C. (250° F.)., and preferably no higher than about 110° C. (230° F.). In most cases, the boiling range falls between 40° and 100° C. (100° F. and 212° F.)., normally in the range of 65° to 95° C. (150° F. to 200° F. and in most cases within the range of 70° to 95° C. (160° F. to 200° F.).

Absorber

Figure 4:
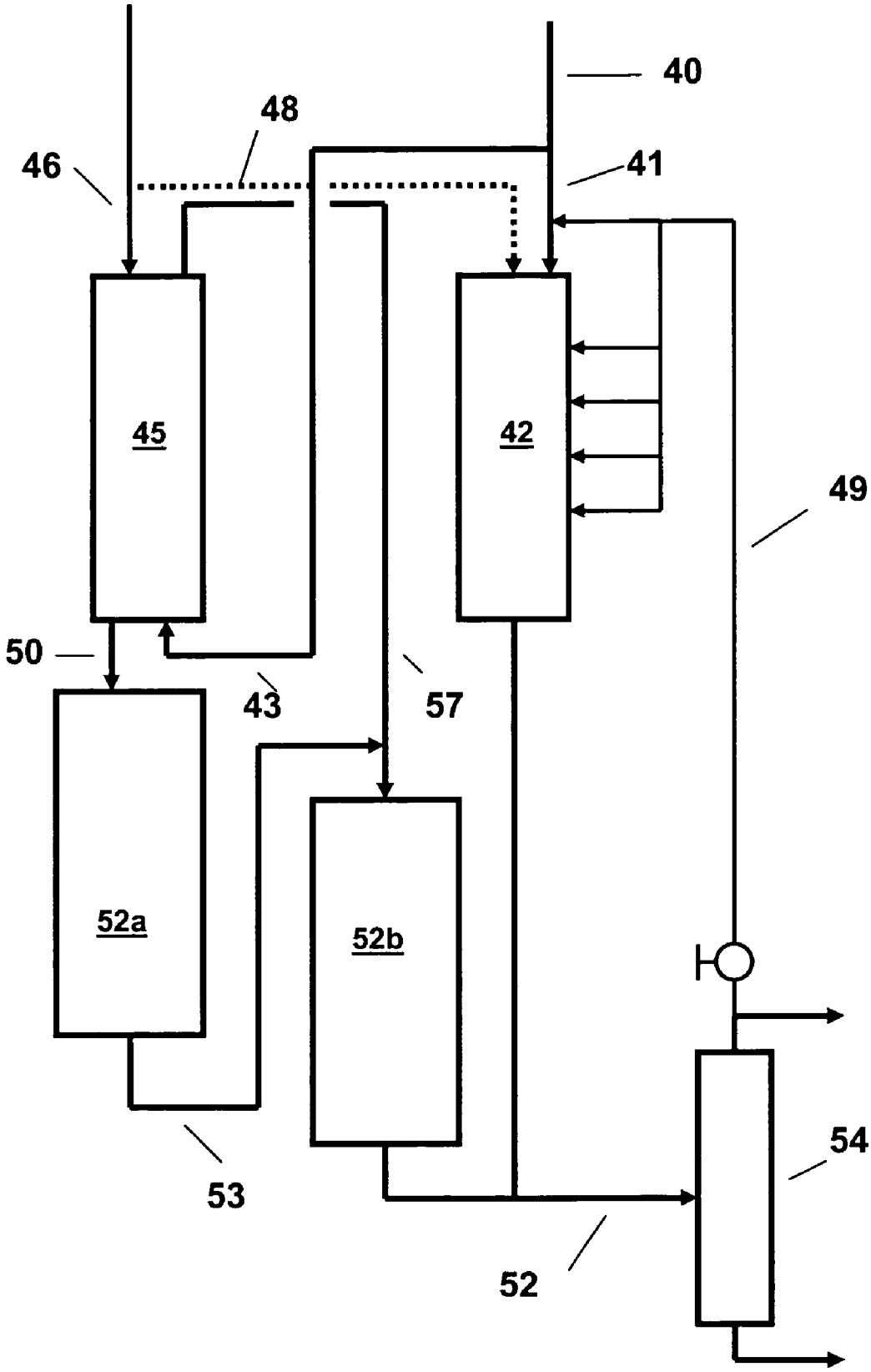
FIG. 4 shows a second process schematic for polymerizing mixed light refinery olefins to form a gasoline boiling range product and for converting the olefins and benzene to motor gasoline in a liquid phase alkylation reaction.

In the liquid phase aromatics alkylation/olefin polymerization unit shown in FIGS. 3 and 4, the aromatic feed and the light olefins pass in contact with one another in the absorber. Contact between the two feeds is carried out so as to promote sorption of the olefins in the liquid aromatic stream. The absorber is typically a liquid/vapor contact tower conventionally designed to achieve good interchange between the two phases passing one another inside it. Such towers usually operate with countercurrent feed flows with the liquid passing downwards by gravity from its entry as lean solvent at the top of the tower while the gas is introduced at the bottom of the tower to pass upwards in contact with the descending liquid with internal tower arrangements to promote the exchange between the phases, for example, slotted trays, trays with bubble caps, structured packing or other conventional expedients. The rich solvent containing the sorbed olefins passes out from the bottom of the tower to pass to the alkylation reactor.

The degree to which the olefins are sorbed by the aromatic stream will depend primarily on the contact temperature and pressure, the ratio of aromatic stream to olefin volume, the compositions of the two streams and the effectiveness of the contacting tower. In general terms, sorption of olefin by the liquid feed stream will be favored by lower temperatures, higher pressures and higher liquid:olefin ratios. The effect of temperature and pressure on the olefin recovery the liquid stream is illustrated briefly in Table 5 below

TABLE 5

| Olefin Recovery | | |
|---|---|---|
| P, kPag (psig) | Temperature, C. (F.) | Percentage Olefin Recovery |
| 1172 (170) | 41 (105) | 58 |
| 1172 (170) | 16 (60) | 69 |
| 1724 (250) | 41 (105) | 69 |
| 1724 (250) | 16 (60) | 76 |
| 3450 (500) | 41 (105) | 69 |
| 3450 (500) | 16 (60) | 94 |

Thus, with absorber operating temperatures and pressures similar to those above, olefin recoveries of 50 to 90 percent can be expected with contactors of conventional efficiency. Sorption of the heavier olefins is favored so that the light gases leaving the absorber will be relatively enriched in these components. As noted in co-pending Application Ser. No. 11/362,255 (claiming priority of U.S. Ser. No. 60/656,945, entitled "Vapor Phase Alkylation Process"), propylene is more reactive for aromatics alkylation at lower temperatures than ethylene and for this reason, the preferential sorption of the propylene component is favorable for the subsequent liquid phase alkylation reaction which is conducted under relatively mild conditions. The conditions selected for absorber operation will therefore affect the ratio of the olefin and aromatic streams to the alkylation reactor. The ratio achieved should be chosen so that there is sufficient olefin to consume the benzene in the aromatic feed under the reaction conditions chosen. Normally, the ratio of olefin to aromatic required for the alkylation step will be in the range of 0.5:1 to 2:1 (see below) and the conditions in the absorber should be determined empirically to achieve the desired ratio.

Unsorbed olefins which pass out of the absorber will be comprised predominantly of the lighter define, principally ethylene which can be more effectively utilized in a higher temperature alkylation step carried out in the vapor phase. As noted above and in application Ser. No. 11/362,255 (claiming priority from U.S. Ser. No. 60/656,945, "Vapor Phase Aromatics Alkylation Process"), ethylene is markedly less active than the heavier olefins especially butene but is amenable to alkylation at higher temperatures than butene, using an intermediate pore size zeolite catalyst such as ZSM-5. This characteristic is effectively exploited in the process unit shown in FIG. 4 which is a modification of the unit of FIG. 3 with a second alkylation reactor, 52*b*, following a first stage alkylation reactor 52*a*. In this case, however, the gases from the olefin stream which are not acted in absorber 45 are sent through line 57 to second stage alkylation reactor 52*b*. The unit is otherwise the same as that of FIG. 3 and like parts are designated similarly.

The two alkylation reactors in FIG. 4, 52*a* and 52*b* are operated in the same sequence as and with comparable conditions to those described in application Ser. No. 11/362,255 priority from U.S. Ser. No. 60/656,945, "Vapor Phase Aromatics Alkylation Process"), with the first stage reactor operating at lower temperature than the second with a catalyst based on a zeolite of the MWW family; the second stage reactor contains a catalyst based on a different intermediate pore size zeolite such as ZSM-5 which is more effective for the alkylation with the ethylene in the off-gas from the absorber. The effluent from the first stage alkylation reactor which passes in transfer line 53 to the second stage alkylation reactor is heated by the exothermic alkylation reaction in the first stage reactor and therefore provides additional process heat to bring the charge to the second stage reactor to the requisite temperature for the higher temperature alkylation reactions which take place in the second stage reactor. Interstage heating may, however, be provided if necessary in order to bring the second stage charge to the required temperature since the cool gas stream from the absorber will reduce the temperature of the effluent from the first alkylation stage.

Catalyst System

The catalyst system used in the olefin polymerization and the aromatics alkylation is preferably one based on a zeolite of the MWW family because these catalysts exhibit excellent activity for the desired aromatic alkylation reaction using light olefins, especially propylene. It is, however, possible to use other molecular sieve catalysts for the alkylation, especially when carried out in the liquid phase, including catalysts based on ZSM-12 as described in U.S. Pat. No. 3,755,483 and U.S. Pat. No. 4,393,262 for the manufacture of petrochemical cumene from refinery benzene and propylene; catalysts based on zeolite beta as described in U.S. Pat. No. 4,891,458 or catalysts based on SSZ-25 as described in U.S. Pat. No. 5,149,894, all of which are reported to have activity for the alkylation of light aromatics by propylene.

MWW Zeolite

The MWW family of zeolite materials has achieved recognition as having a characteristic framework structure which presents unique and interesting catalytic properties. The MWW topology consists of two independent pore systems: a sinusoidal ten-member ring [10 MR] two dimensional channel separated from each other by a second, two dimensional pore system comprised of 12 MR super cages connected to each other through 10 MR windows. The crystal system of the MWW framework is hexagonal and the molecules diffuse along the [100] directions in the zeolite, i.e., there is no communication along the c direction between the pores. In the hexagonal plate-like crystals of the MWW type zeolites, the crystals are formed of relatively small number of units along the c direction as a result of which, much of the catalytic activity is due to active sites located on the external surface of the crystals in the form of the cup-shaped cavities. In the interior structure of certain members of the family such as MCM-22, the cup-shaped cavities combine together to form a supercage. The MCM-22 family of zeolites has attracted significant scientific attention since its initial announcement by Leonovicz et al. in Science 264, 1910-1913 [1994] and the later recognition that the family includes a number of zeolitic materials such as PSH 3, MCM-22, MCM 49, MCM 56, SSZ 25, ERB-1, ITQ-1, and others. Lobo et al. AIChE Annual Meeting 1999, Paper 292J.

The relationship between the various members of the MCM-22 family have been described in a number of publications. Three significant members of the family are MCM-22, MCM-36, MCM-49, and MCM-56. When initially synthesized from a mixture including sources of silica, alumina, sodium, and hexamethylene imine as an organic template, the initial product will be MCM-22 precursor or MCM-56, depending upon the silica: alumina ratio of the initial synthesis mixture. At silica:alumina ratios greater than 20, MCM-22 precursor comprising H-bonded vertically aligned layers is produced whereas randomly oriented, non-bonded layers of MC-56 are produced at lower silica:alumina ratios. Both these materials may be converted to a swollen material by the use of a pillaring agent and on calcination, this leads to the laminar, pillared structure of MCM-36. The as-synthesized MCM-22 precursor can be converted directly by calcination to MCM-22 which is identical to calcined MCM-49, an intermediate product obtained by the crystallization of the randomly oriented, as-synthesized MCM-56. In MCM-49, the layers are covalently bonded with an interlaminar spacing slightly greater than that found in the calcined MCM-22/MCM 49 materials. The unsynthesized MCM-56 may be calcined itself to form calcined MCM 56 which is distinct from calcined MCM-22/MCM-49 in having a randomly oriented rather than a laminar structure. In the patent literature MCM-22 is described in U.S. Pat. No. 4,954,325 as well as in U.S. Pat. Nos. 5,250,777; 5,284,643 and 5,382,742. MCM-49 is described in U.S. Pat. No. 5,236,575; MCM-36 in U.S. Pat. No. 5,229,341 and MCM-56 in U.S. Pat. No. 5,362,697.

The preferred zeolitic material for use as the MWW component of the catalyst system is MCM-22. It has been found that the MCM-22 may be either used fresh, that is, not having been previously used as a catalyst or alternatively, regenerated MCM-22 may be used. Regenerated MCM-22 may be used after it has been used in any of the catalytic processes (including the present process or any of its process components) for which it is known to be suitable but one form of regenerated MCM-22 which has been found to be highly effective in the present condensation process is MCM-22 which is previously been used for the production of aromatics such as ethylbenzene or cumene, normally using reactions such as alkyaltion and transalkylation. The cumene production (alkylation) process is described in U.S. Pat. No. 4,992,606 (Kushnerick et al). Ethylbenzene production processes are described in U.S. Pat. No. 3,751,504 (Keown); U.S. Pat. No. 4,547,605 (Kresge); and U.S. Pat. No. 4,016,218 (Haag); U.S. Pat. Nos. 4,962,256; 4,992,606; 4,954,663; 5,001,295; and 5,043,501 describe alkylation of aromatic compounds with various alkylating agents over catalysts comprising MWW zeolites such as PSH-3 or MCM-22. U.S. Pat. No. 5,334,795 describes the liquid phase synthesis of ethylbenzene with MCM-22.

The MCM-22 catalysts may be regenerated after catalytic use in the cumene, ethylbenzene and other aromatics production processes by conventional air oxidation techniques similar to those used with other zeolite catalysts.

Intermediate Pore Size Zeolite

As noted above, out a second alkylation step may be carried out (FIG. 4) using different conditions in order to react the lighter portion of the olefin feed, predominantly ethylene, with additional aromatic feed. In this case, the reaction is preferably carried out in the vapor phase under higher temperature conditions using an different molecular sieve catalyst containing an intermediate pore size zeolite such as ZSM-5 which is more active for ethylene/aromatic alkylation. This family of zeolites is characterized by an effective pore size of generally less than about 0.7 nm, and/or pore windows in a crystal structure formed by 10-membered rings. The designation "intermediate pore size" means that the zeolites in question generally exhibit an effective pore aperture in the range of about 0.5 to 0.65 nm when the molecular sieve is in the H-form. The effective pore size of zeolites can be measured using standard adsorption techniques and compounds of known minimum kinetic diameters. See Breck, Zeolite *Molecular Sieves,* 1974 (especially Chapter 8), and Anderson et al, *J. Catalysis* 58,114 (1979).

The medium or intermediate pore zeolites are represented by zeolites having the structure of ZSM-5, ZSM-11, ZSM-23, ZSM-35, ZSM-48 and TMA (tetramethylammonium) offretite. Of these, ZSM-5 and ZSM-11 are preferred for functional reasons while ZSM-5 is preferred as being the one most readily available on a commercial scale from many suppliers.

The activity of the zeolitic component of the catalyst or catalysts used in the present process is significant. The acid activity of zeolite catalysts is conveniently defined by the alpha scale described in *J. Catalysis,* Vol. VI, pp. 278-287 (1966). In this text, the zeolite catalyst is contacted with hexane under conditions prescribed in the publication, and the amount of hexane which is cracked is measured. From this measurement is computed an "alpha" value which characterizes the catalyst for its cracking activity for hexane. This alpha value is used to define the activity level for the zeolites. For the purposes of this process, the catalyst should have an alpha value greater than about 1.0; if it has an alpha value no greater than about 0.5, will be considered to have substantially no activity for cracking hexane. The alpha value of the intermediate pore size zeolite of the ZSM-5 type preferentially used for the ethylene/aromatic reaction is preferably at least 10 or more, for example, from 50 to 100 or even higher. The alpha value of the MWW zeolite preferably used in the liquid phase reaction is less critical although values of at least 1 are required for perceptible activity higher values over 10 are preferred.

Catalyst Matrix

In addition to the zeolitic component, the catalyst will usually contain a matrix material or binder in order to give adequate strength to the catalyst as well as to provide the desired porosity characteristics in the catalyst. High activity catalysts may, however, be formulated in the binder-free form by the use of suitable extrusion techniques, for example, as described in U.S. Pat. No. 4,908,120. When used, matrix materials suitably include alumina, silica, silica alumina, titania, zirconia, and other inorganic oxide materials commonly used in the formulation of molecular sieve catalysts. For use in the present process, the level of MCM-22 or ZSM-5 type (intermediate pore size) zeolite in the finished matrixed catalyst will be typically from 20 to 70% by weight, and in most cases from 25 to 65% by weight. In manufacture of a matrixed catalyst, the active ingredient will typically be mulled with the matrix material using an aqueous suspension of the catalyst and matrix, after which the active component and the matrix are extruded into the desired shape, for example, cylinders, hollow cylinders, trilobe, quadlobe, etc. A binder material such as clay may be added during the mulling in order to facilitate extrusion, increase the strength of the final catalytic material and to confer other desirable solid state properties. The amount of clay will not normally exceed 10% by weight of the total finished catalyst. Unbound (or, alternatively, self-bound) catalysts are suitably produced by the extrusion method described in U.S. Pat. No. 4,582,815, to which reference is made for a description of the method and of the extruded products obtained by its use. The method described there enables extrudates having high constraining strength to be produced on conventional extrusion equipment and accordingly, the method is eminently suitable for producing the catalysts which are silica-rich. The catalysts are produced by mulling the zeolite with water to a solids level of 25 to 75 wt % in the presence of 0.25 to 10 wt % of basic material such as sodium hydroxide. Further details are to be found in U.S. Pat. No. 4,582,815.

Product Formation, Products

Polymerization Product

With gasoline as the desired product, a high quality product is obtained from the polymerization step, suitable for direct blending into the refinery gasoline pool after fractionation as described above. With clean feeds, the product is correspondingly low in contaminants. The product is high in octane rating with RON values of 95 being regularly obtained and values of over 97 being typical; MON is normally over 80 and typically over 82 so that (RON+MON)/2 values of at least 89 or 90 are achievable with mixed propylene/butene feeds. Of particular note is the composition of the octenes in the product with a favorable content of the higher-octane branched chain components. The linear octenes are routinely lower than with the SPA product, typically being below 0.06 wt. pct. except at the highest conversions and even then, the linears are no higher than those resulting from SPA catalyst. The higher octane di-branched octenes are noteworthy in consistently being above 90 wt. pct., again except at the highest conversions but in all cases, higher than those from SPA; usually, the di-branched octenes will be at least 92 wt. pct of all octenes and in favorable cases at least 93 wt. pct.. The levels of tri-branched octenes are typically lower than those resulting from the SPA process especially at high conversions, with less than 4 wt. pct being typical except at the highest conversions when 5 or 6 wt. pct. may be achieved, approximately half that resulting from SPA processing. In the C5-200° C. product fraction, high levels of di-branched C8 hydrocarbons may be found, with at least 85 weight percent of the octene components being di-branched C8 hydrocarbons, e.g. 88 to 96 weight percent di-branched C8 hydrocarbons.

Alkylation Product

During the alkylation process, a number of mechanistically different reactions take place. The olefins in the feed react with the single ring aromatics in the aromatic feed to form high-octane number single ring alkylaromatics. As noted above, the ethylene-aromatic alkylation reactions are favored over intermediate pore size zeolite catalysts while propylene-aromatic reactions being favored over MWW zeolite catalysts.

The principle reactions of alkylation and transalkylation reactions between the aromatics and the olefins will predominate significantly over the minor degree of olefin oligomerization which occurs since the aromatics are readily sorbed onto the catalyst and preferentially occupy the catalytic sites making olefin self-condensation reactions less likely to occur as long as sufficient aromatics are present. Reaction rates and thermodynamic considerations also favor direct olefin-aromatic reactions. Whatever the involved mechanisms are, however, a range of alkylaromatic products can be expected with varying carbon numbers.

The objective normally will be to produce products having a carbon number no higher than 14 and preferably not above 12 since the most valuable gasoline hydrocarbons are at $C_7$-$C_{12}$ from the viewpoint of volatility including RVP and engine operation at varying conditions. Di-and tri-alkylation is therefore preferred since with the usual $C_2$, $C_3$ and $C_4$ olefins and a predominance of benzene in the aromatic feed, alkylaromatic products with carbon numbers from about 10 to 14 are readily achievable. Depending on the feed composition, operating conditions and type of unit, the product slate may be varied with optimum conditions for any given product distribution being determined empirically.

After separation of light ends from the final reactor effluent stream, the gasoline boiling range product is taken from the stripper or fractionator. Because of its content of high octane number alkylaromatics, it will normally have an octane number of at least 92 and often higher, e.g. 95 or even 98. This product forms a valuable blend component for the refinery blend pool for premium grade gasoline.

Process Parameters

The olefin polymerization will be carried out under the reaction conditions set out in co-pending application Ser. No. 11/362,257 (claiming priority from U.S. Ser. No. 60/656,954, "Gasoline Production By Olefin Polymerization"). The alkylation steps will be carried out under the reaction conditions set out in co-pending application No. (claiming priority from U.S. Ser. No. 60/656,955, "Process For Making High Octane Gasoline With Reduced Benzene Content"); application Ser. No. 11/362,255 (claiming priority from U.S. Ser. No. 60/656,945, "Vapor Phase Aromatics Alkylation Process") and application Ser. No. 11/362,139 (claiming priority from U.S. Ser. No. 60/656,946,"Liquid Phase Aromatics Alkylation Process"), to which reference is made for a description of these conditions, as applicable to the combined steps of the present integrated process.

Polymerization Reaction

The polymerization may be operated at relatively low temperatures and under moderate pressures. In general, the temperature will be from about 100° to 300° C. (about 210° to 570° F.), more usually 120° to 260° C. (about 250 to 500° F.) and in most cases between 150° and 200° C. (about 300° to 390° F.). Temperatures of 170° to 200° C. (about 340° to 390° F.) will normally be found optimum for feeds comprising butene while higher temperatures will normally be appropriate for feeds with significant amounts of propene. Ethylene, again, will require higher temperature operation to ensure that the products remain in the gasoline boiling range. Pressures will normally be dependent on unit constraints but usually will not exceed about 10,000 kPag (about 1450 psig) with low to moderate pressures, normally not above 7,500 kPag (about 1,100 psig) being favored from equipment and operating considerations although higher pressures are not unfavorable in view of the volume change in the reaction; in most cases, the pressure will be in the range of 2000 to 5500 kPag e.g. 3500 Kpag (about 290 to 800 psig, e.g. about 500 psig) in order to make use of existing equipment. Space velocities can be quite high, giving good catalyst utilization. Space velocities are normally up to 50 WHSV $hr^{-1}$, e.g. in the range of 10 to 40 $hr^{-1}$ WHSV, in most cases, 5 to 30 $hr^{-1}$ WHSV with operation in the range of 20-30 WHSV being feasible. Optimum conditions may be determined empirically, depending on feed composition, catalyst aging and unit constraints.

The olefin polymerization may take place under vapor phase, liquid phase or supercritical phase conditions (reactor inlet). At the reactor outlet, liquid phase will prevail under normal conditions with the oligomerization product including significant proportions of $C_8$, $C_{10}$ and higher hydrocarbons. With significant amounts of ethylene (FCC Off Gas) in the feed, operation will commence (reactor inlet) in the vapor phase and when higher olefins including propylene and butene are present, operation will commence in the supercritical phase.

By appropriate adjustment of the reaction conditions in the polymerization reactor, the product distribution may be modified: shorter feed/catalyst contact times tend to a product distribution with lower molecular weight oligomers while relatively longer contact times lead to higher molecular weight (higher boiling products). So, by increasing feed/catalyst contact time, it is possible to produce products in the middle distillate boiling range, for example, road diesel and kerojet blend stocks. Overall feed/catalyst contact time may be secured by operating at low space velocity or by increasing the recycle ratio to the reactor.

Alkylation

The present process is notable for its capability of being capable of operation at low to moderate pressures. In general, pressures up to about 7,000 kPag (approximately 1,000 psig) will be adequate. As a matter of operating convenience and economy, however, low to moderate pressures up to about 3,000 kPag (about 435 psig) will be preferred, permitting the use of low pressure equipment. Pressures within the range of about 700 to 15,000 kPag (about 100 to 2,175 psig) preferably 1500 to 4,000 kPag (about 220 to 580 psig) will normally be suitable.

In the liquid phase operation, the overall temperature will be from about 90° to 250° C. (approximately 195° to 390° F.) but normally not more than 200° C. (about 390° F.). The temperature may be controlled by the normal expedients of controlling feed rate, and operating temperature or, if required by dilution or quench. If the additional vapor phase step is used, reaction conditions will be more forcing over the intermediate pore size zeolite to attain the desired ethylene conversion.

In the vapor phase operation, the overall temperature, in general, will be from about 90° to 325° C. (approximately 190° to 620° F.). With the preferred two stage process, using the configuration of MWW-stage first, the feed (first stage reactor inlet) is preferably held in the range of 90° to 250° C. (approximately 190°to 480° F.) with the first stage exotherm controlled to achieve a second stage reactor (ZSM-5 type catalyst) within the range of 200° to 325° C. (approximately 400° to 620° F.). The temperature may be controlled by the normal expedients of controlling feed rate, quench injection rate and dilution ratio; if required, the temperature differential between the two steps of the reaction may be controlled by injection of inert quench or excess reformate.

In the liquid phase operation, the overall temperature will be from about 90to 250° C. (approximately 195° to 480° F.), normally not more than 200° C. (about 390° F.). The temperature may be controlled by the normal expedients of controlling feed rate, and operating temperature or, if required by dilution or quench. If the additional vapor phase step is used, reaction conditions will be more forcing over the intermediate pore size zeolite to attain the desired ethylene conversion.

Two factors affecting choice of temperature will be the feed composition and the presence of impurities, principally in the olefin feed stream. As noted above, ethylene is less reactive than propylene and for this reason, ethylene containing feeds will require higher temperatures than feeds from which this component is absent, assuming of course that high olefin conversion is desired. From this point of view, reaction temperatures at the higher end of the range, i.e. above 180° C. or higher, e.g. 200° or 220° C. or higher, will be preferred for ethylene-containing feeds. Sulfur will commonly be present in the olefin feeds from the FCC unit in the form of various sulfur-containing compounds e.g. mercaptans, and since sulfur acts as a catalyst poison at relatively low reaction temperatures, typically about 120° C., but has relatively little effect at higher temperatures about 180° C. or higher, e.g. 200° C., 220° C., the potential for sulfur compounds being present may dictate a preferred temperature regime above about 150° C., with temperatures above 180° C. or higher being preferred, e.g. 200° or 220° C. or higher. Typically, the sulfur content will be above 1 ppmw sulfur and in most cases above 5 ppmw sulfur; it has been found that with a reaction temperature above about 180-220° C., sulfur levels of 10 ppmw can be tolerated with no catalyst aging, indicating that sulfur levels of 10 ppmw and higher can be accepted in normal operation.

In both cases, the space velocity on the olefin feed to the alkylation reaction will normally be from 0.5 to 5.0 WHSV ($hr^{-1}$) and in most cases from 0.75 to 3.0 WHSV ($hr^{-1}$) with a value in the range of 1.0 to 2.5 WHSV ($hr^{-1}$) being a convenient operating value. The ratio of aromatic feed to olefin will depend on the aromatic content of the feed, principally the benzene content which is to be converted to alkylaromatics and the utilization of the aromatics and olefins under the reaction conditions actually used. Normally, the aromatics:olefin ratio will be from about 0.5:1 to 5:1 by weight and in most cases from 1:1 to 2:1 by weight. No added hydrogen is required.

The invention claimed is:

1. A method for producing a gasoline boiling range product from a mixed light olefinic feed stream comprising light olefins from ethylene up to butene and a liquid aromatic feed stream including single ring aromatic compounds, which process comprises:

splitting the mixed light olefinic stream to form two mixed light olefinic streams, passing one of the two mixed light olefinic feed streams to a fixed bed of an olefin condensation catalyst comprising as the active catalytic component, an MWW zeolitic material to form a polymeric gasoline boiling range product by polymerization of the olefins in the stream;

extracting olefins from the other of the two mixed light Fight olefinic feed streams by passing the olefinic feed stream in contact with the aromatic feed stream at a temperature to dissolve olefins in the liquid aromatic feed stream, passing the aromatic stream containing the extracted olefins to an alkylation step in which the aromatics are alkylated with the extracted olefins in the liquid phase over a fixed bed of a solid molecular sieve alkylation catalyst, to Form a gasoline boiling range product containing akylaromatics, combining the polymeric gasoline boiling range product and the gasoline boiling range product containing akylaromatics to form a gasoline boiling range product.

2. A method according to claim 1 in which the aromatic feed stream comprises a reformate.

3. A process according to claim 1 in which the mixed light olefin feed stream comprises $C_2$ to $C_4$ olefins.

4. A process according to claim 1 in which the polymerization is carried out over a molecular sieve catalyst comprising a zeolite of the MWW family.

5. A process according to claim 4 in which the zeolite of the MWW family over which the polymerization is carried out comprises MCM-22.

6. A process according to claim 1 in which the alkylation in the liquid phase is carried out over a molecular sieve catalyst comprising a zeolite of the MWW family.

7. A process according to claim 6 in which the zeolite of the MWW family over which the alkylation in the liquid phase is carried out comprises MCM-22.

8. A process according to claim 7 in which the alkylation is carried out in a second step in the vapor phase over an alkylation catalyst comprising a different intermediate pore size zeolite.

9. A process according to claim 8 in which the alkylation is carried out in the vapor phase over an alkylation catalyst comprising a ZSM-5 zeolite.

10. A process according to claim 1 in which the liquid aromatic stream containing the extracted olefins is passed to an alkylation step in which the aromatics in the stream are alkylated with the extracted olefins over a fixed bed of a solid molecular sieve alkylation catalyst comprising a zeolite of the MWW family in a liquid phase reaction at a temperature in the range of 90° to 250° C. and a pressure not more than 7,000 kPag, to form the gasoline boiling range product containing akylaromatics.

11. A method according to claim 10, in which the olefinic feed stream is reacted with the aromatic feed stream in the liquid phase in the presence of the catalyst at a temperature from 150° to 250° C.

12. A process according to claim 1 in which the mixed light olefin feed stream comprises ethylene, propylene and butene and the olefins are extracted selectively from the olefinic stream under conditions favoring extraction of the higher olefins in the olefinic stream to form an aromatic stream enriched in propylene and butene which is passed to the alkylation step and an olefinic effluent, containing ethylene which is passed to an alkylation step in which the aromatic stream is alkylated with the ethylene in the effluent stream in the vapor phase over an alkylation catalyst comprising ZSM-5.

13. A process according to claim 12 in which the aromatic stream is alkylated with the ethylene in the effluent stream over the ZSM-5 catalyst at a temperature of 200° to 325° C.

14. A process according to claim 12 in which effluent from the liquid phase alkylation step is passed to the vapor phase alkylation step together with olefinic effluent containing ethylene from the olefin extraction step to alkylate the aromatic stream in the vapor phase over the ZSM-5 alkylation catalyst.

* * * * *